US011702863B2

(12) United States Patent
Beck

(10) Patent No.: US 11,702,863 B2
(45) Date of Patent: Jul. 18, 2023

(54) DOOR HANDING ASSEMBLY FOR ELECTROMECHANICAL LOCKS

(71) Applicant: Spectrum Brands, Inc., Middleton, WI (US)

(72) Inventor: Chasen Beck, Costa Mesa, CA (US)

(73) Assignee: Spectrum Brands, Inc., Middleton, WI (US)

( * ) Notice: Subject to any disclaimer, the term of this patent is extended or adjusted under 35 U.S.C. 154(b) by 37 days.

(21) Appl. No.: 17/403,367

(22) Filed: Aug. 16, 2021

(65) Prior Publication Data

US 2022/0081938 A1 Mar. 17, 2022

Related U.S. Application Data

(63) Continuation of application No. 15/987,317, filed on May 23, 2018, now Pat. No. 11,091,936.

(60) Provisional application No. 62/509,897, filed on May 23, 2017.

(51) Int. Cl.

| | |
|---|---|
| ***E05B 63/04*** | (2006.01) |
| ***E05B 17/22*** | (2006.01) |
| *E05B 47/00* | (2006.01) |
| *E05B 47/02* | (2006.01) |

(52) U.S. Cl.

CPC ..... *E05B 63/04* (2013.01); *E05B 17/22* (2013.01); *E05B 47/0012* (2013.01); *E05B 47/026* (2013.01); *E05B 2047/0036* (2013.01); *E05B 2047/0067* (2013.01); *E05B 2047/0072* (2013.01)

(58) Field of Classification Search

CPC ..... E05B 63/04; E05B 63/042; E05B 17/22; E05B 47/0012; E05B 47/026; E05B 2047/0036; E05B 2047/0067; E05B 2047/0072; E05B 2045/065

See application file for complete search history.

(56) References Cited

U.S. PATENT DOCUMENTS

| | | | |
|---|---|---|---|
| 8,686,869 B2 | 4/2014 | Sharma et al. | |
| 9,024,759 B2 | 5/2015 | Uyeda et al. | |
| 9,512,644 B2 | 12/2016 | Lambrou et al. | |
| 11,091,936 B2 | 8/2021 | Beck | |
| 2011/0185554 A1* | 8/2011 | Huang | B23P 11/00 70/277 |

(Continued)

*Primary Examiner* — Kristina R Fulton
*Assistant Examiner* — James E Ignaczewski
(74) *Attorney, Agent, or Firm* — Merchant & Gould P.C.

(57) ABSTRACT

A method for detecting a handed configuration of a door includes providing an electronic lock, which includes a latch assembly that includes a bolt movable between an extended position and a retracted position and a motor that is configured to drive the bolt between the extended position and the retracted position. The latch assembly includes a control circuit for controlling the motor to selectively move the bolt, at least one sensor in electrical communication with the control circuit, and at least one orientation indicator. The method includes detecting the presence of the at least one the orientation indicator and identifying a handed configuration based on the detection by the at least one sensor. The method includes driving, by the control circuit, the motor based on the identified handed configuration. The control circuit identifies the handed configuration without moving the bolt between the extended position and the retracted position.

20 Claims, 6 Drawing Sheets

(56) References Cited

U.S. PATENT DOCUMENTS

| | | | | |
|---|---|---|---|---|
| 2012/0167646 | A1* | 7/2012 | Sharma | E05C 1/02 356/399 |
| 2013/0340491 | A1* | 12/2013 | Lambrou | E05B 47/0012 70/277 |
| 2014/0240956 | A1 | 8/2014 | Nishio et al. | |
| 2015/0308157 | A1* | 10/2015 | Lin | E05B 47/026 292/144 |
| 2017/0198496 | A1* | 7/2017 | Beck | E05B 17/22 |
| 2017/0226784 | A1 | 8/2017 | Davis et al. | |

* cited by examiner

DOOR HANDING ASSEMBLY FOR ELECTROMECHANICAL LOCKS

CROSS REFERENCE TO RELATED APPLICATION

This application is a continuation of U.S. application Ser. No. 15/987,317, filed May 23, 2018, now U.S. Pat. No. 11,091,936; which claims the benefit of U.S. Provisional Application No. 62/509,897, filed May 23, 2017, which applications are hereby incorporated by reference in their entireties.

TECHNICAL FIELD

The present disclosure relates generally to locks. In particular, the present disclosure relates to an electromechanical lock with a feature that determines the handing of the door into which the lock is installed.

BACKGROUND

Doors can be right-handed or left-handed. The door's handing—whether it is right-handed or left-handed—impacts the location where the door's lock is installed, either on the left or right hand side of the door. Depending on this location, the lock's bolt may face to the left or right.

Door handing impacts how a deadbolt is actuated. In many existing deadbolt latch assemblies, for example, the bolt extends when the latch's hub rotates in a first direction and retracts when the hub rotates in an opposite direction. The direction in which the hub rotates to extend/retract the bolt differs depending on whether the deadbolt faces left or right. If the deadbolt faces to the left, for example, the rotation of the hub in a clockwise direction may extend the bolt while rotation in the counter-clockwise direction may retract the bolt. Conversely, if the deadbolt faces to the right, the rotation of the hub in the counter-clockwise direction may extend the bolt while rotation in the clockwise direction may retract the bolt. Accordingly, door handing impacts which direction the hub needs to be rotated to extend and retract the bolt.

In electronic deadbolts, the latch's hub is typically driven by a motor. A control circuit selectively drives the motor in a forward or reverse direction to extend or retract the bolt. However, the control circuit must learn the door handing to know whether driving the motor in a forward direction corresponds with extending the bolt, or if the forward direction retracts the bolt; likewise, this informs the control circuit whether driving the motor in a reverse direction corresponds with retracting or extending the bolt.

With existing electronic deadbolts, the user must typically set the door handing, such as with user-actuated switches on the lock. However, door handing can be unintuitive to some users and makes installation more complex. Although some existing electronic deadbolts include a door handing process that allows the control circuit to detect the door handing, there are downsides. For example, these processes typically involve interaction with the user, such as initiating the door handing detection process and instructions to the user regarding door position, which can make lock installation more difficult.

These existing processes typically drive the latch assembly to extend and retract the bolt during the handing detection process. For example, one way in which existing control circuits detect door handing is by detecting resistance, such as torque, in driving the motor in the forward and reverse directions. Another way in which existing electronic deadbolts detect door handing is through sensors that detect movement of the latch assembly while the motor is driven in the forward and reverse directions. This works for latch assemblies in which movement between retraction/extension is asymmetrical so handing can be detected, but for latch assemblies that have symmetrical movement, this type of arrangement is not feasible. Therefore, there is a need for a novel way to detect door handing during lock installation.

BRIEF DESCRIPTION OF THE DRAWINGS

The detailed description makes reference to the accompanying figures in which.

DETAILED DESCRIPTION

Figure 1:
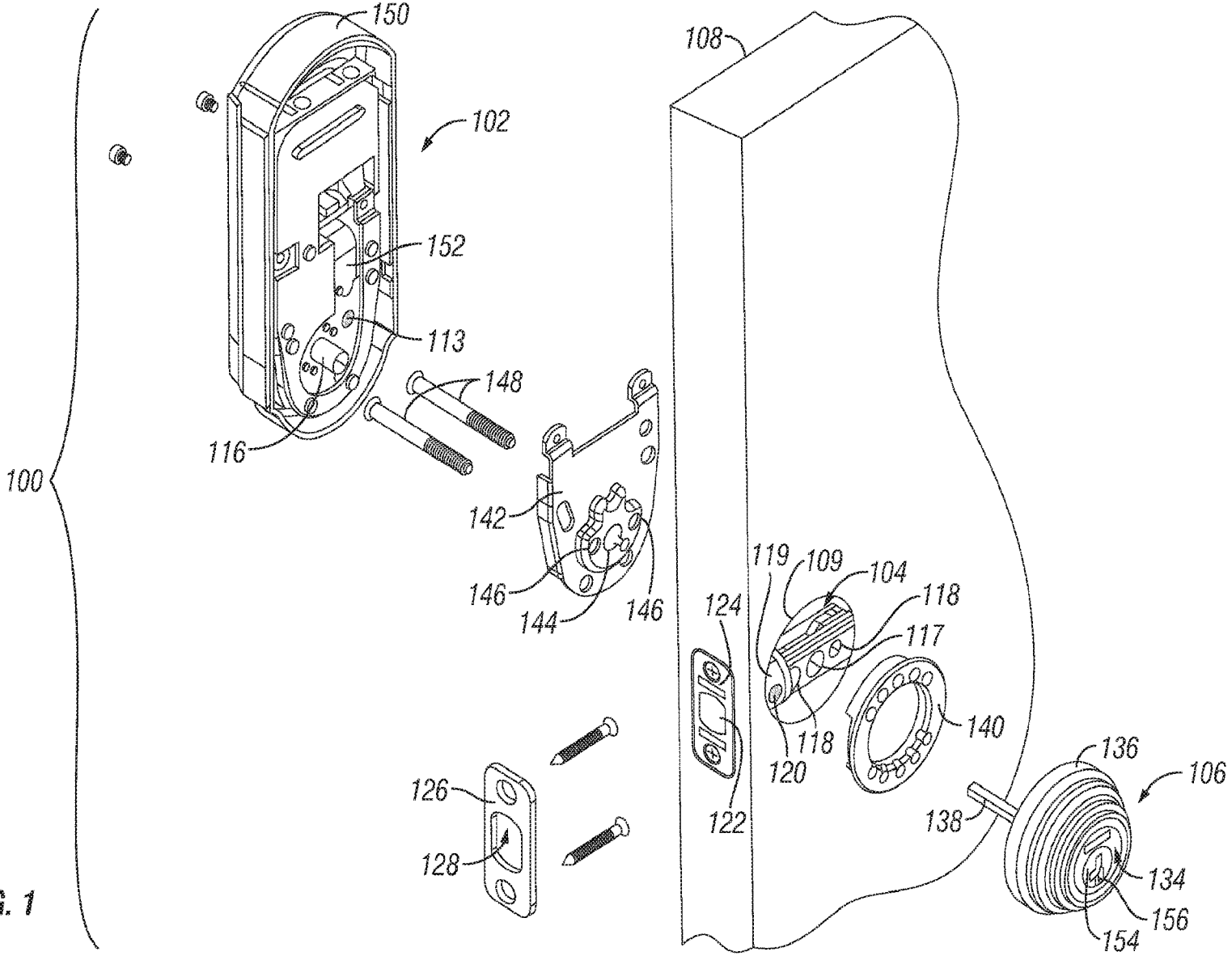
FIG. 1 is an exploded view of an example lock assembly with a door handing detection feature installed in a bore hole of a door according to an embodiment of the disclosure.

The figures and descriptions provided herein may have been simplified to illustrate aspects that are relevant for a clear understanding of the herein described devices, systems, and methods, while eliminating, for the purpose of clarity, other aspects that may be found in typical devices, systems, and methods. Those of ordinary skill may recognize that other elements and/or operations may be desirable and/or necessary to implement the devices, systems, and methods described herein. Because such elements and operations are well known in the art, and because they do not facilitate a better understanding of the present disclosure, a discussion of such elements and operations may not be provided herein. However, the present disclosure is deemed to inherently include all such elements, variations, and modifications to the described aspects that would be known to those of ordinary skill in the art.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. Additionally, it should be appreciated that items included in a list in the form of "at least one A, B, and C" can mean (A); (B); (C); (A and B); (A and C); (B and C); or (A, B, and C).

Similarly, items listed in the form of "at least one of A, B, or C" can mean (A); (B); (C); (A and B); (A and C); (B and C); or (A, B, and C).

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures. Additionally, the inclusion of a structural or method feature in a particular figure is not meant to imply that such feature is required in all embodiments and, in some embodiments, may not be included or may be combined with other features.

This disclosure relates generally to an electronic lock with a door handing detection feature. Unlike existing door handing detection processes, embodiments of this door handing detection feature do not require movement of the latch assembly to detect handing, which leads to an easier lock installation process. Further, unlike existing door handing detection processes, embodiments are described in which the door handing detection feature can detect handing regardless of whether the latch assembly is asymmetrical about the y-axis. Additionally, embodiments are described in which no user input or instructions are necessary for the door handing detection feature to determine handing, which eases the installation process.

Figure 2:
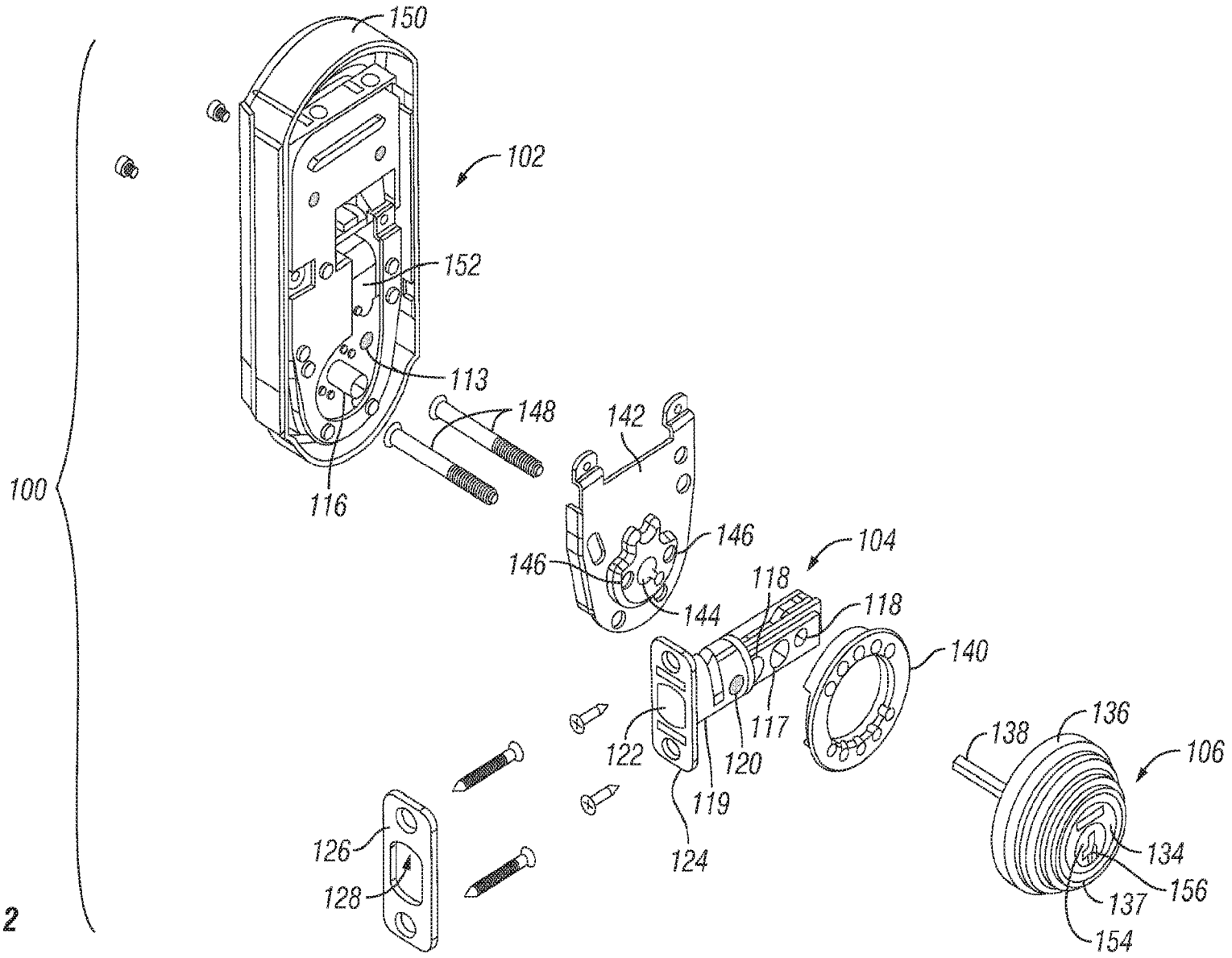
FIG. 2 is an exploded view of the example lock assembly shown in FIG. 1 without the door.

FIGS. 1 and 2 show an exploded view of an example lock assembly 100 with a control circuit including a door handing detection feature according to an embodiment of this disclosure, with and without a door, respectively. Example lock assemblies into which the door handing detection feature could be integrated are described in U.S. Pat. No. 9,024,759 for a "Wireless Lockset with Integrated Antenna, Touch Activation, and Light Communication Method" and U.S. Pre-grant Publication No. 2014/0240956 for an "Electronic Deadbolt," both of which are hereby incorporated by reference. Although the lock assembly is discussed herein as an electronic deadbolt for purposes of example, the door handing detection feature could be implemented in other types of locks depending on the circumstances.

In the example shown, the lock assembly 100 includes an interior assembly 102, a latch assembly 104, and an exterior assembly 106. Typically, the interior assembly 102 is mounted on the inside of a door 108, while the exterior assembly 106 is mounted outside of the door 108. The latch assembly 104 is typically mounted in a bore hole 109 formed in the door 108. The term "inside" is broadly used to denote an area inside a door and "outside" is also broadly used to mean an area outside a door. For example, with an exterior entry door, the interior assembly 102 may be mounted inside a building and the exterior assembly 106 may be mounted outside a building. In another example, with an interior door, the interior assembly 102 may be mounted inside a room secured by the lock assembly 100 located inside a building, and the exterior assembly 106 may be mounted outside the secured room. The lock assembly 100 is applicable to both interior and exterior doors. The lock assembly 100 may also be used in such a way to secure any room with the interior assembly 102 located on the inside of the room and the exterior assembly 106 located on the outside of the room. The lock assembly 100 may also be used in a way where the interior assembly 102 is located outside a door and the exterior assembly 106 is located inside the door.

In the example shown in FIG. 1, the lock assembly 100 is installed in a right-handed door (with a bolt 122 facing left from the outside). As explained below, the handing detection feature would be able to detect the right-handed configuration, and the control circuit would drive the latch in the correct direction for extension and retraction of the bolt 122. In some cases, the lock assembly 100 may be installed in a left-handed door (with the bolt 122 facing right from the outside) and the control circuit would be able to detect the left-handed configuration to drive the latch in the opposite direction of a right-handed door.

In the embodiment shown, the exterior assembly 106 includes a mechanical lock assembly 134, a cylinder guard cover 136, and a torque blade 138. Although the example exterior assembly 106 includes a mechanical lock assembly 134 for manually actuating the lock assembly 100 with a physical key, this is optional and embodiments are contemplated in which the lock assembly 100 could be validated solely through electric means (e.g., with an electronic key via a user input device, such as a keypad, biometric sensor, smart phone, key fob, etc.) and there may not be a mechanical lock assembly 134 depending on the circumstances. As shown, the mechanical lock assembly 134 includes a lock cylinder 154 with a keyway 156 through which a valid key can be inserted to manually operate the lock cylinder 154. The lock cylinder 154 is operatively connected with the torque blade 138, such that rotation of the lock cylinder with a valid key also rotates the torque blade 138. The torque blade 138 is used to actuate the latch assembly 104, and thereby move the bolt 122 between its extended and retracted positions.

In the embodiment shown, the exterior assembly 106 is in electrical communication with the interior assembly 102 for electrically unlocking/locking the locking assembly 100. The exterior assembly 106 could be in electrical communication with the interior assembly 102 with a wiring harness (not shown), wirelessly, etc. In some embodiments, the exterior assembly 106 could be used to receive and communicate an electronic key to a control circuit 152 in the interior assembly 102 for authentication, such as through a keypad (not shown), a biometric sensor (not shown), wirelessly, etc.

The torque blade 138 extends through an optional adapter 140 in the embodiment shown, which is received within the bore 109 of the door 108 to which the lock assembly 100 is being installed or mounted, and then through a hub 117 of the latch assembly 104. The rotation of the torque blade 138 also rotates the hub 117, which actuates the bolt 122 between an extended position and a retracted position. The rotation of the hub 117 in a first direction will extend the bolt 122 while rotation in a second direction will retract the bolt 122. As discussed above, the rotational direction of the hub 117 that corresponds with the extension or retraction of the bolt 122 differs depending on whether the lock assembly 100 is installed in a left-handed or right-handed door. The door handing detection feature of the control circuit will detect whether the torque blade 138 should be driven in a clockwise or counter-clockwise direction for extension of the bolt 122 and vice versa for retraction.

In some embodiments, the door handing detection feature could use one or more orientation indicators associated with the latch assembly 104 to detect door handing in conjunction with one or more sensors extending from the latch assembly 104. For example, the control circuit could include one or more sensors for detecting the orientation sensor(s) on the latch assembly 104 to determine door handing as described below. In the embodiment shown, a first orientation indicator 120 is associated with a first side of the latch assembly 104 and a second orientation indicator 121 (FIGS. 3 and 4) is associated with an opposing side of the latch assembly 104. Although this example shows two orientation indicators, one orientation indicator or more than two orientation indicators could be coupled to the latch assembly 104 to determine handing of the lock assembly 100. The orientation indicators 120, 121 have a fixed position on the latch assembly 104 and do not move with movement of the bolt 122 between its extended and retracted positions.

In the example shown, a first sensor 113 (FIGS. 3 and 4) is spaced apart from a second sensor 114 (FIGS. 3 and 4) for detecting the first orientation indicator 120 and the second orientation indicator 121, respectively. In one embodiment, the first sensor 113 is positioned on the interior assembly 102 to be proximate the first orientation indicator 120 when the lock assembly 100 is installed in a right-handed door, but the second sensor 114 is spaced apart from the first orientation indicator 120 such that only the first sensor 113 detects the first orientation indicator 120 and not the second sensor 114. Conversely, the second sensor 114 is positioned to detect the second orientation indicator 121 when the lock assembly 100 is installed in a left-handed door and not the first sensor 113. Accordingly, in this example, the control circuit 152 could detect whether the lock assembly 100 is in a right-handed door or a left-handed door based on whether the first sensor 113 detects the first orientation indicator 120 or whether the second sensor 114 detects the second orientation indicator 121, respectively. Of course, depending on the circumstances, the first sensor 113 could be used to detect a left-handed configuration and the second sensor 114 a right-handed installation. Consider an example in which the first orientation indicator 120 and the second orientation indicator 121 are magnets and the first sensor 113 and the second sensor 114 are magnetic sensors, such as Hall-effect sensors. The sensors 113, 114 could be oriented with respect to the orientation indicators 120, 121, such that only the first sensor 113 detects the magnetic field of the first orientation indicator 120 when installed in a right-handed configuration and only the second sensor 114 detects the magnetic field of the second orientation indicator 121 when installed in a left-handed configuration. Although magnets and magnetic sensors are described for purposes of example, other types of sensors and indications could be used depending on the circumstances. This example shows the sensors in the interior assembly 102, but the sensors could be positioned in the exterior assembly 106 and/or a combination of the interior and exterior assemblies 102, 106 depending on the circumstances.

The bolt 122 moves linearly in and out of a sleeve 119. When the bolt 122 is in a retracted position, the end of the bolt 122 is generally flush with a base plate 124. When the bolt 122 is in an extended position, the bolt 122 protrudes through an opening 128 of a strike plate 126, which is positioned in a jamb adjacent the door 108. A retracted position is broadly used to denote an "unlocked" position and an extended position is broadly used to denote a "locked" position.

In the embodiment shown, the torque blade 138 extends through the hub 117 of the latch assembly 104 through a mounting plate 142. In this embodiment, the mounting plate 142 is attached to an interior side of the door 108. The mounting plate 142 includes an opening 144 to receive the torque blade 138 and fastener openings 146 to receive fasteners 148 to couple the mounting plate 142 to the door 108. The torque blade 138 passes through the opening 144 to be received in a spindle driver 116 of the interior assembly 102. The spindle driver 116 is operatively coupled with a turn-piece (not shown) of the interior assembly 102 to manually actuate the latch assembly 104 from inside the door 108.

Figure 5:
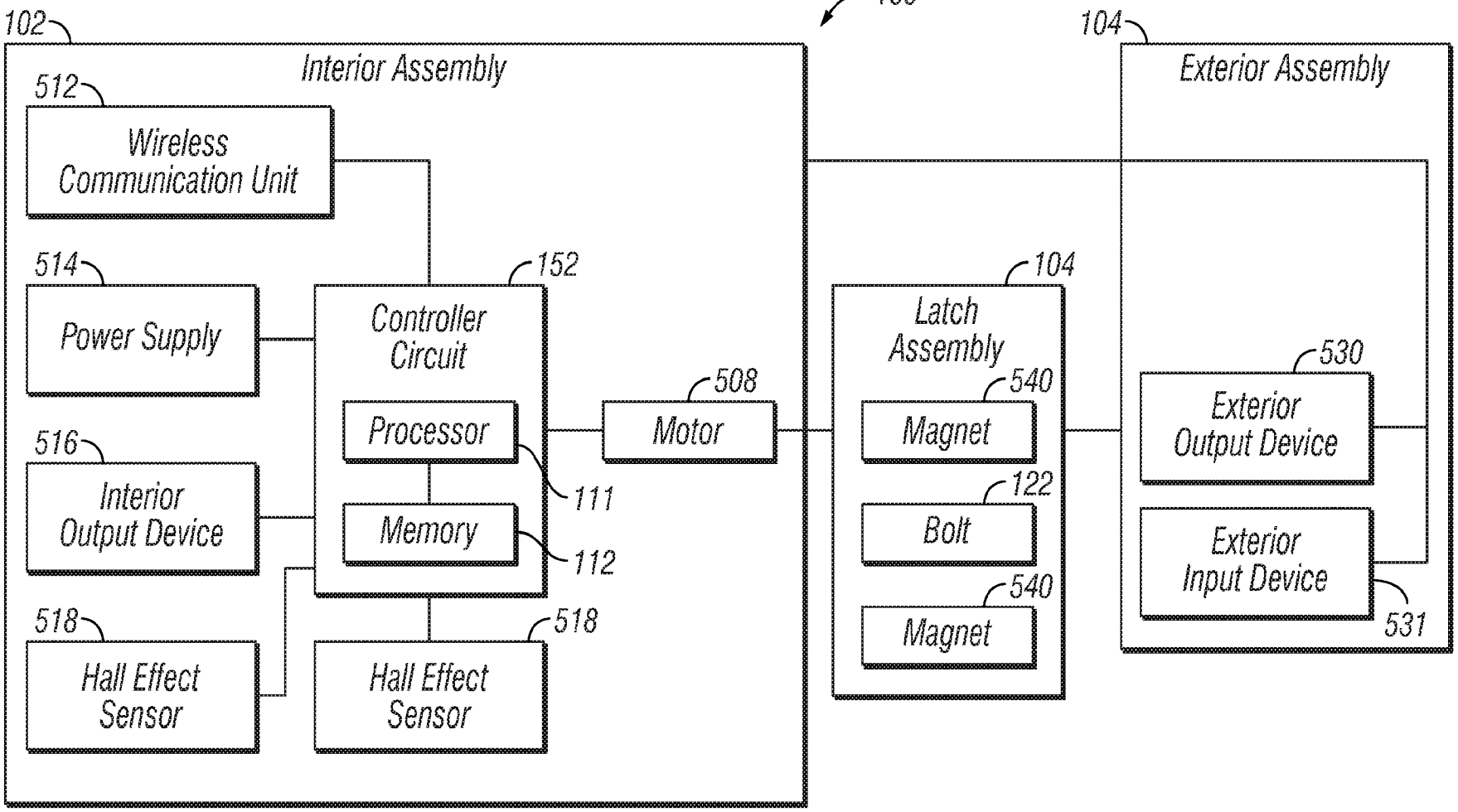
FIG. 5 is a simplified block diagram of an example lock assembly for determining handing of the lockset according to an embodiment of the disclosure.

In the embodiment shown, the interior assembly 102 includes a housing 150 that defines a recessed area for internal components of the interior assembly 102. The interior assembly 102 includes a control circuit 152 that selectively controls a motor 508 (FIG. 5). The motor 508 is operatively connected with the spindle driver 116. Since the torque blade 138 is received in the spindle driver 116, the motor 508 controls rotation of the spindle driver 116, which rotates the torque blade 138 to actuate the latch assembly 104 and move the bolt 122 between its extended and retracted positions.

The control circuit 152 includes a door handing detection feature that detects the door handing to determine whether driving the motor in a forward or reverse direction corresponds to extending or retracting the bolt 122. As discussed above, the control circuit 152 may include one or more sensors for determining door handling based on detection of one or more orientation indicator(s). For example, the detection of an orientation indicator by one sensor could mean a right-handed configuration and detection by another sensor could mean a left-handed configuration. Based on the handed configuration detected (e.g., either left-handed or right-handed), the control circuit 152 will set the direction of the motor 508 to drive the spindle driver 116 that corresponds to extending and retracting the bolt 122.

Figure 3:
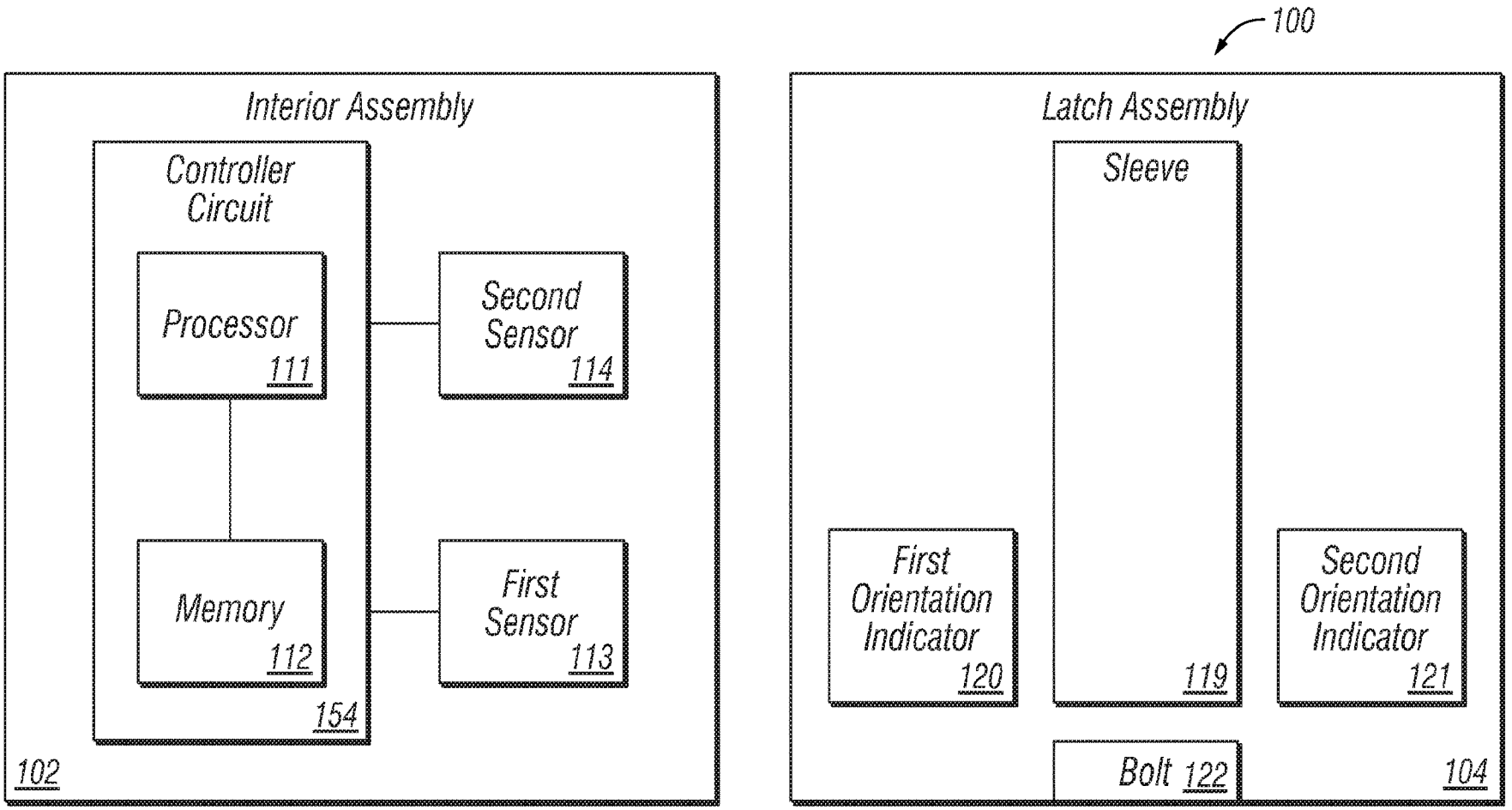
FIG. 3 is a simplified block diagram of an example configuration of an example lock assembly according to an embodiment of the disclosure.
Figure 4:
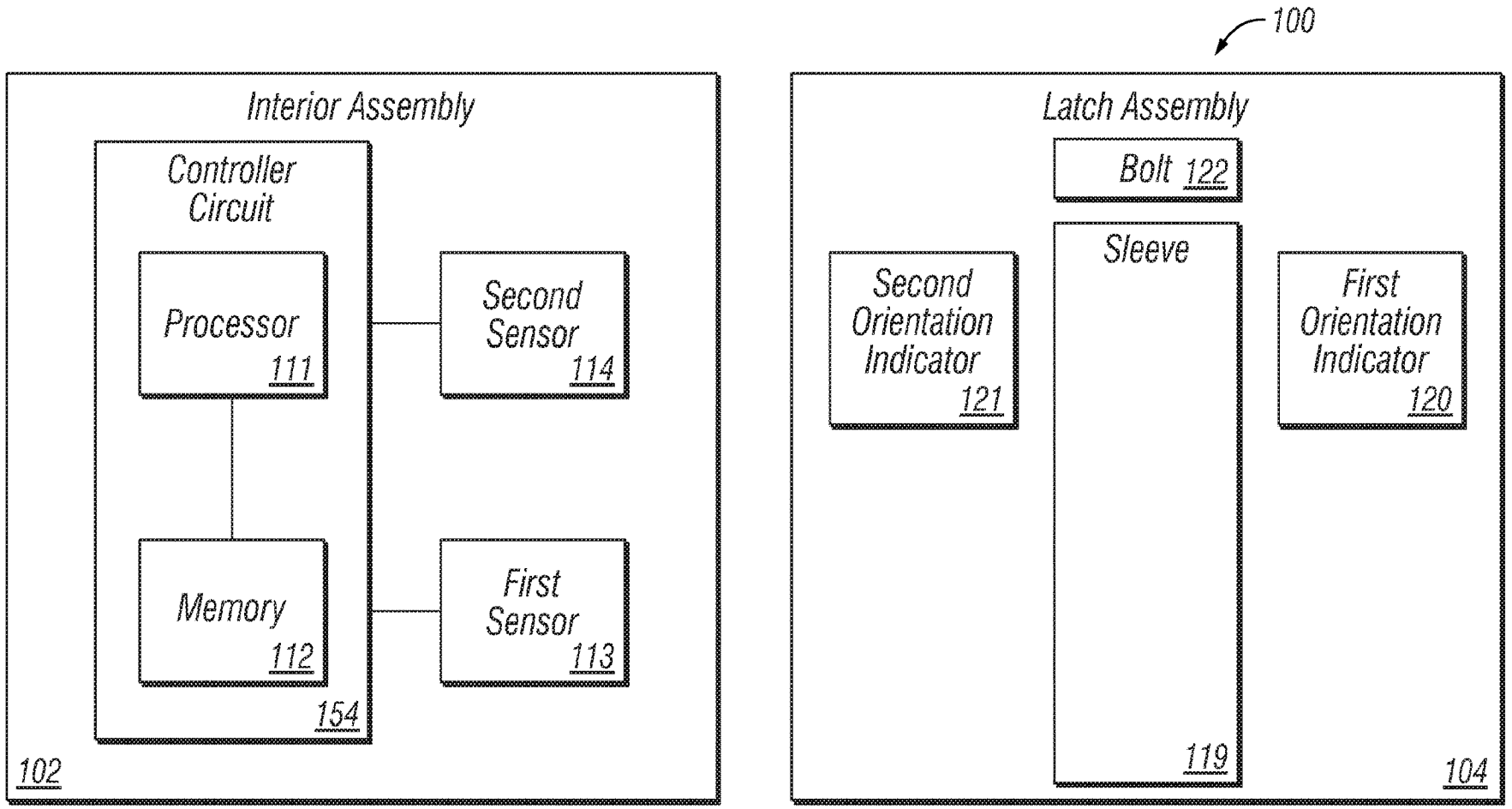
FIG. 4 is a simplified block diagram of another example configuration of the lock assembly according to an embodiment of the disclosure.

FIG. 3 diagrammatically shows an installation of the lock assembly 100 in a first handed configuration while FIG. 4 shows the lock assembly 100 installed in a second handed configuration. The first handed configuration could be right-handed or left-handed and the second handed configuration is opposite of the first handed configuration. For example, if the first handed configuration is left-handed, the second handed configuration would be right-handed and vice versa.

In the example shown, the interior assembly 102 includes a control circuit 152, a first sensor 113, and a spaced-apart second sensor 114. The control circuit 152 includes a processor 111 to process instructions stored in memory 112. As shown, the latch assembly 104 includes the stationary sleeve 119 on which the first orientation indicator 120 and the second orientation indicator 121 are located. In other embodiments, the first orientation indicator 120 and the second orientation indicator 121 could be located on other locations of the latch assembly 104 or another position of the lock assembly 100. As shown, the first orientation indicator 120 is axially aligned with the first sensor 113 along an axis approximately transverse to the longitudinal axis of the latch assembly 104 in the configuration of FIG. 3 while the second sensor 114 is axially aligned with the second sensor 114 in the configuration of FIG. 4. The proximal alignment of the sensors 113, 114 and corresponding orientation indicators 120, 121 allows detection of the handed configuration in which the lock assembly 100 is installed.

In one embodiment, the control circuit 152 receives signals from the first sensor 113 and the second sensor 114 to determine the handing of the lock assembly 100. The handed configurations determine which direction the motor 508 must go to drive the spindle driver 116 to extend and retract the bolt 122 of the latch assembly 104. Depending on the handed configuration, the lock assembly 100 will be configured to unlock and lock by driving the bolt 122 in a specific direction in order to perform an extension and retraction of the bolt 122. In one embodiment, the first sensor 113 and/or the second sensor 114 are configured to wirelessly detect the first orientation sensor 120 and/or the second orientation sensor 121, respectively. For example, the sensors 113, 114 could be magnetic sensors and the orientation indicators 120, 121 could be magnets affixed to each side of the sleeve 119. The sensors 113, 114 could detect the magnetic field of the orientation indicators. Other embodiments are contemplated in which the sensors could detect the orientation indicators such as using an optical, ultrasonic, infrared, radio frequency, mechanical switches, or other types of sensors as described below.

In the embodiment shown in FIG. 3, the control circuit 152 would receive a signal from the first sensor 113 if the first sensor 113 detects the first orientation indicator 120 indicating a first handed configuration. As shown, the first sensor 113 is adjacent to the first orientation indicator 120 located on the latch assembly 104 for the first sensor 113 to detect the first orientation indicator 120. In one embodiment, the latch assembly 104 defines a longitudinal axis where the first orientation indicator 120 and the second orientation indicator 121 are spaced apart transversely about the longitudinal axis of the latch assembly 104. In some cases, the first sensor 113 is arranged on the interior assembly 102 to be approximately coaxial with the first orientation indicator 120 in a first handed configuration, and the second sensor 114 is spaced apart from the first sensor 113 to be axially offset from the first orientation indicator in a first handed configuration. In some embodiments, the proximity of the first sensor 113 to the first orientation indicator 120 allows the first sensor 113, but not the second sensor 114, to detect the first orientation indicator 120 to indicate a first handed configuration; likewise, the proximity of the second sensor 114 to the second orientation indicator 121 can be used to detect a second handed configuration, and vice versa. In one embodiment, the control circuit 152 would be configured to control a motor 508 to drive the bolt 122 between the extended position and the retracted position in the forward mode and the reverse mode corresponding with a first handed configuration responsive to the first sensor 113 detecting the first orientation indicator 120 as shown in FIG. 3.

In FIG. 4, the components are similar to what is shown in FIG. 3, but the latch assembly 104 is in a second handed orientation with the bolt 122 facing the opposite direction from the first handed configuration so the interior assembly 102 is placed on a different side of the latch assembly 104. In the second handed configuration shown in FIG. 4, the second sensor 114 is adjacent to the second orientation indicator 121 for the second sensor 114 to detect the second orientation indicator 121. Although these examples show the second sensor 114 aligned with the second orientation indicator 121 in the second handed configuration, the second sensor 114 could be used to identify the first handed configuration in some embodiments. As shown, the second sensor 114 is arranged on the interior assembly to be approximately coaxial with the second orientation indicator 121 in a second handed configuration, and the first sensor 113 is spaced apart from the second sensor 114 to be axially offset from the second orientation indicator 121 in a second handed configuration. With this arrangement, the second sensor 114 detects the second orientation indicator 121 due to the proximity of the two components when the latch assembly 104 is in the second handed configuration, but the first sensor 113 does not detect the second orientation indicator 121.

In another embodiment, the first sensor 113 may be configured to detect the second orientation indicator 121 and the second sensor 114 may be configured to detect the first orientation indicator 120. The first sensor 113 may be in the position of the second sensor 114 and vice versa. In one embodiment, the first sensor 113 may be arranged on the interior assembly 102 such that the first sensor 113 is configured to detect the first orientation indicator 120 in the left-handed configuration but does not detect the first orientation indicator 120 in the right-handed configuration. The first sensor 113 may also not detect the second orientation indicator 121 in the left-handed configuration and may detect the second orientation indicator 121 in the right-handed configuration. The second sensor 114 may be arranged on the interior assembly 102 such that the second sensor 114 is configured to detect the second orientation indicator 121 in the right-handed configuration but does not detect the second orientation indicator 121 in the left-handed configuration. The second sensor 114 may also not detect the first orientation indicator 120 in the right-handed configuration and may detect the first orientation indicator 121 in the left-handed configuration. In another embodiment, the sensors 113, 114 may be swapped so that the first sensor 113 is configured to detect the second orientation indicator 121 in the right-handed configuration but does not detect the second orientation indicator 121 in the left-handed configuration and vice versa for the second sensor 114. That is, the roles of the sensors 113, 114 are not configured to be specific to one orientation indicator 120, 121, but may interact with other orientation indicators. In another embodiment, the first orientation indicator 120 may be indicative of a right-handed configuration and the second orientation indicator 121 may be indicative of a left-handed configuration. As a result, the interaction between the first sensor 113 and the first orientation indicator 120 may detect a right-handed configuration and the interaction between the second sensor 114 and the second orientation indicator 121 may detect a left-handed configuration.

In another embodiment, there may only be one sensor and one orientation indicator. In an illustrative embodiment, the lock assembly 100 may be configured to either a left-handed configuration or a right-handed configuration initially. The lock assembly 100 may be installed with the preconfigured handed configuration. The lock assembly 100 may use the one sensor to detect the one orientation indicator to change the handed configuration to either the left-handed configuration or the right-handed configuration. The lock assembly 100 may maintain the preconfigured handed configuration if an orientation indicator is not detected. In another embodiment, there may be multiple orientation indicators and the sensors 113, 114 may interact with the multiple orientation indicators in order to determine a left-handed configuration or a right-handed configuration.

In one embodiment, the sensors 113, 114 could be embodied as magnetic sensors, such as Hall Effect sensors, and the orientation indicators 120, 121 could be embodied as magnets. The sensors 113, 114 may be configured to detect magnetic energy emanating from at least one of the orientation indicators 120, 121 in one handed configuration, but not in another handed configuration. For example, the first sensor 113 may be configured to detect magnetic energy emanating from the first orientation indicator 120 in the left-handed configuration, but does not detect the first orientation indicator 120 in the right-handed configuration. In another example, the second sensor 114 is configured to detect magnetic energy emanating from the second orientation indicator 121 in the right-handed configuration, but does not detect the second orientation indicator 121 in the left-handed configuration.

In another embodiment, at least one of the sensors 113, 114 could be embodied as an optical sensor and at least one of the orientation indicators 120, 121 is embodied as reflective or non-reflective tape. The sensors 113, 114 may be configured to detect a reflection or a lack of a reflection from at least one of the orientation indicators 120, 121 in one handed configuration, but not in another handed configuration. For example, the first sensor 113 may be configured to detect a reflection or a lack of a reflection from the first orientation indicator 120 in the left-handed configuration, but does not detect the first orientation indicator 120 in the right-handed configuration. In another example, the second sensor 114 is configured to detect a reflection or a lack of a reflection from the second orientation indicator 121 in the right-handed configuration, but does not detect the second orientation indicator 121 in the left-handed configuration.

In another embodiment, at least one of the sensors 113, 114 could be embodied as a mechanical switch and the at least one of the orientation indicators 120, 121 could be embodied as a protrusion extending transversely from the latch assembly 104. The mechanical switch may be configured to be actuated by the protrusion of the latch assembly 104. The sensors 113, 114 and at least one of the orientation indicators 120, 121 may be embodied as other mechanical switches and actuator pairs. The length of the protrusion may be different for at least one of the orientation indicators 120, 121 compared to the other at least one of the orientation indicators 120, 121 in order to provide differentiation. The sensors 113, 114 may be configured to detect a protrusion of the latch assembly 104 from at least one of the orientation indicators 120, 121 in one handed configuration, but not in another handed configuration. For example, the first sensor 113 may be configured to detect a protrusion of the latch assembly 104 from the first orientation indicator 120 in the left-handed configuration, but does not detect the first orientation indicator 120 in the right-handed configuration. In another example, the second sensor 114 is configured to detect a protrusion of the latch assembly 104 from the second orientation indicator 121 in the right-handed configuration, but does not detect the second orientation indicator 121 in the left-handed configuration.

In another embodiment, at least one of the sensors 113, 114 could be embodied as an ultrasonic proximity switch or ultrasonic proximity sensor and at least one of the orientation indicators 120, 121 could be embodied as a protrusion extending transversely from the latch assembly 104 or a recessed area of the latch assembly 104. For an embodiment with a protrusion, the length of the protrusion may be different for at least one of the orientation indicators 120, 121 compared to the other orientation indicators 120, 121 in order to provide differentiation. For an embodiment with a recessed area, the depth of the recessed area of the latch assembly 104 may be different for at least one of the orientation indicators 120, 121 compared to at least one of the other orientation indicators 120, 121 in order to provide differentiation. The sensors 113, 114 may be configured to detect a protrusion or a recessed area of the latch assembly from the at least one of the orientation indicators 120, 121 in one handed configuration, but not in another handed configuration. For example, the first sensor 113 may be configured to detect a protrusion of the latch assembly 104 or a recessed area of the latch assembly 104 from the first orientation indicator 120 in the left-handed configuration, but does not detect the first orientation indicator 120 in the right-handed configuration. In another example, the second sensor 114 is configured to detect a protrusion of the latch assembly 104 or a recessed area of the latch assembly 104 from the second orientation indicator 121 in the right-handed configuration, but does not detect the second orientation indicator 121 in the left-handed configuration.

In one embodiment, at least one of the sensors 113, 114 could be embodied as a radio frequency ("RF") receiver and the at least one of the orientation indicators 120, 121 could be embodied as a radio frequency ("RF") transmitter or reflector. The frequency at which the orientation indicators 120, 121 transmit a RF signal may be different compared to at least one of the other orientation indicators 120, 121 to provide differentiation. The sensors 113, 114 may be configured to detect a RF signal transmitted from at least one of the orientation indicators 120, 121 in one handed configuration, but not in another handed configuration. For example, the first sensor 113 may be configured to detect a RF signal transmitted from the first orientation indicator 120 in the left-handed configuration, but does not detect the first orientation indicator 120 in the right-handed configuration. In another example, the second sensor 114 could be configured to detect a RF signal transmitted from the second orientation indicator 121 in the right-handed configuration, but does not detect the second orientation indicator 121 in the left-handed configuration.

FIG. 5 diagrammatically shows an example lock assembly 100 similar to the example shown in FIG. 1 according to an embodiment of the disclosure. In the example shown, the lock assembly 100 includes the interior assembly 102, the exterior assembly 106, the latch assembly 104, and the motor 508. As described above, the interior assembly 102 is mounted on the inside of a door and the exterior assembly 106 is mounted on the outside of the door. As described above, the latch assembly 104 is typically mounted in a bore 109 formed in the door 108 and is operatively connected to the motor 508 via the torque blade 138. The motor 508 is electrically coupled to the control circuit 152. As shown, the interior assembly 102 is electrically coupled to the exterior assembly 104.

In the embodiment shown, the interior assembly 102 includes a wireless communication unit 512, a power supply 514, an interior output device 516, two sensors embodied as Hall Effect sensors 518, and the control circuit 152. In the embodiment shown, the wireless communication unit 512 is electrically coupled to the control circuit 152. The wireless communication unit 512 may be used to communicate with an electronic key such as a key fob, a smartphone, a wireless communication device, etc. The wireless communication unit may communicate with the electronic key using Bluetooth™, Wi-Fi, or other wireless communication protocols. In the embodiment shown, the power supply 514 is located in the interior assembly 102 and supplies power for electrical components in both the interior assembly 102 and exterior assembly 104, but the exterior assembly 104 could have a separate power supply in some embodiments.

As shown, the control circuit 152 is electrically coupled to the interior output device 516 and two Hall Effect sensors 518. The interior output device 516 may be embodied as a light communication device and/or an audible alarm, etc. In some cases, the interior output device 516 may signal to a user a certain configuration of the lock assembly 100 indicative of handing. For example, if the control circuit 152 determines that the handing of the lock assembly 100 is a right-handed configuration, then the control circuit 152 could send a signal to the interior output device 516 to signal to the user that the lock assembly 100 is in a right-handed configuration and/or left-handed configuration.

In the embodiment shown, the exterior assembly 104 includes an exterior output device 530 and exterior input device 531. The exterior output device 530 may be embodied as a light communication device or an audible alarm. For example, the exterior output device 530 may provide a notification to a user using the lock assembly 100 that a valid authentication code was received or an invalid authentication code was received. The exterior input device 531 may be embodied as a capacitive touch sensor keypad, or any other input device. The exterior input device 531 receives input from a user to interact with the lock assembly 100. A user may input an authentication code or other data into the exterior input device 531.

In the embodiment shown, the latch assembly 104 includes the bolt 122 and two orientation indicators embodied as magnets 540. The magnets 540 may be coupled to any location of the latch assembly 104. The latch assembly 104 is coupled to both the interior assembly 102 and the exterior assembly 106 through the motor 508. The interior assembly 102 may actuate the bolt 122 through the motor 508 as described above. The exterior assembly 106 may also actuate the bolt 122 through a mechanical lock assembly as described above.

In one embodiment, the control circuit 152 is configured to control the motor 508 to drive the bolt 122 between the extended position and the retracted position in the forward mode and the reverse mode corresponding with a left-handed configuration responsive to the Hall Effect sensors 518 detecting a magnet 540 depending on which Hall Effect sensor 518 detected the magnet 540 as described above. The magnets 540 may be positioned and arranged on the latch assembly 104 in such a way that only one of the Hall Effect sensors 518 may detect one of the magnets 540 during the installation process. The control circuit 154 is also configured to control the motor 508 to drive the bolt 122 between the extended position and the retracted position in the forward mode and the reverse mode corresponding with a right-handed configuration responsive to the Hall Effect sensors 518 detecting a magnet 540 depending on which Hall Effect sensor 518 detected the magnet 540 as described above.

Figure 6:
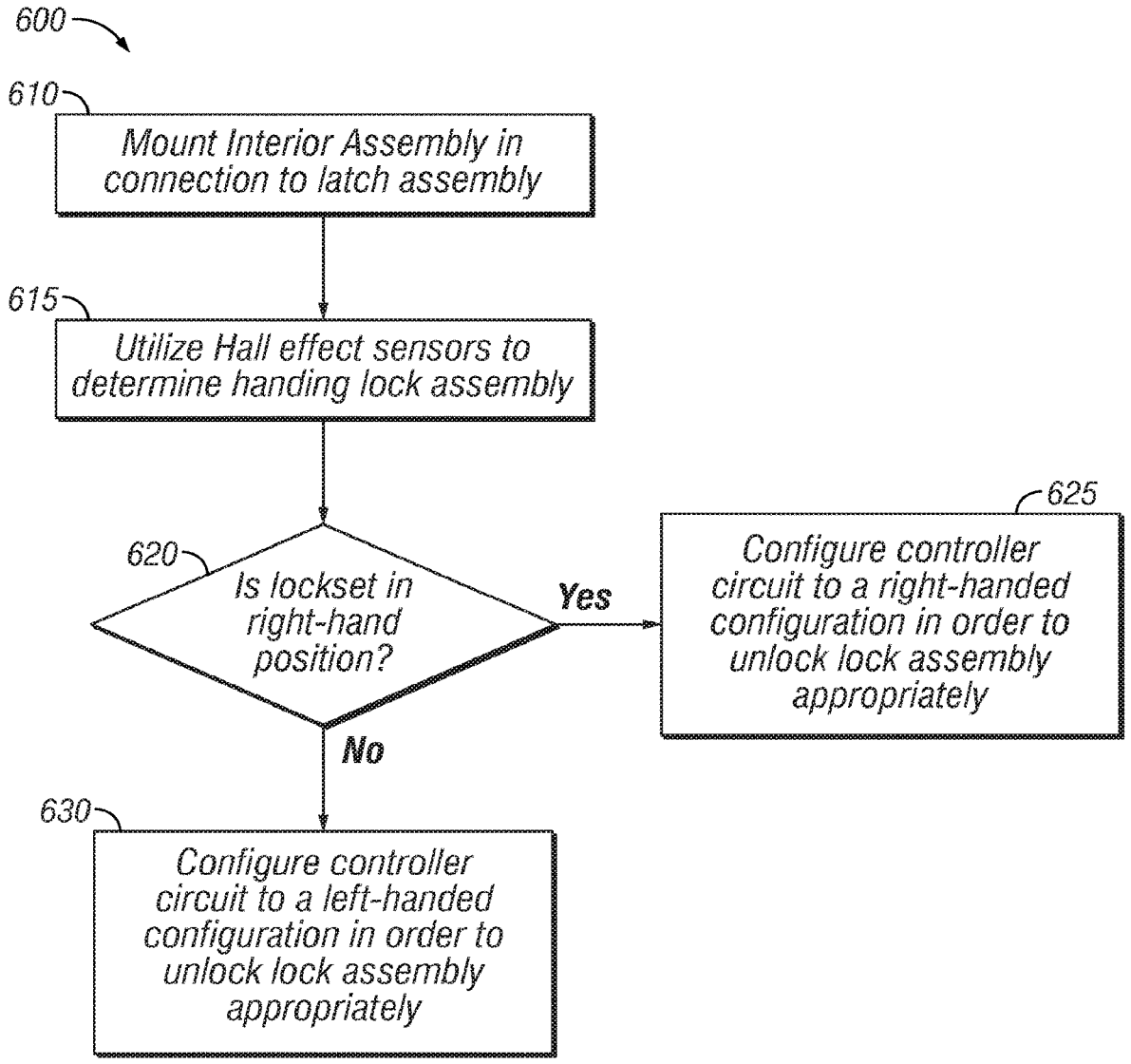
FIG. 6 is a simplified flowchart showing an example installation of an example lock assembly for determining handing of the lockset according to an embodiment of the disclosure.

FIG. 6 is a simplified flow chart showing an example installation of the lock assembly 100. In the example shown, the user mounts the interior assembly 102 to the door 108 and the latch assembly 104 (operation 610). After operation 610, the process continues to operation 615 where the control circuit 152 determines whether first sensor 113 or second sensor 114 (e.g., Hall Effect sensor, optical sensor, proximity sensor, etc.) detects the first and/or second orientation indicators 120, 121 (e.g., the magnetic field, lights, etc. emanating from the indicators). After operation 615, the process continues to operation 620 where the control circuit 152 determines if the lock assembly 100 is in a right-handed configuration based on which sensor 113, 114 detects the first and/or second orientation indicators 120, 121. The process continues to operation 625 where the control circuit 152 sets the handed configuration to a right-handed configuration if the control circuit 152 identifies a right-handed circuit based on the sensors 113, 114. If the control circuit 152 determines the lock assembly 100 is in a left-handed configuration based on the sensors 113, 114, the control circuit 152 sets the handed configuration to a left-handed configuration. By setting the handed configuration, the control circuit 152 selects whether to drive the motor 508 in the forward and reverse directions correspond to driving the bolt 122 between the extended position and the retracted position. In another embodiment, operation 625 could identify whether the handed configuration is left-handed (instead of detecting a right-handed configuration) as shown in the example of FIG. 6.

EXAMPLES

Illustrative examples of the lockset disclosed herein are provided below. An embodiment of the lockset may include any one or more, and any combination of, the examples described below.

Example 1 is an electronic lock with a latch assembly including a bolt movable between a retracted position and an extended position. The latch assembly defines a longitudinal axis. The lock includes at least one orientation indicator connected with the latch assembly. The orientation indicator remains in a fixed position on the latch assembly when the bolt moves between the retracted position and the extended position. A motor is provided that is configured to drive the bolt between the extended position and the retracted position, wherein the motor is configured to drive in a forward mode and a reverse mode. The lock includes at least one sensor positioned with respect to the latch assembly to detect the at least one orientation indicator when the electronic lock is installed in a first handed configuration, but not in a second handed configuration. A control circuit is configured to control the motor for selectively moving the bolt between the retracted position and the extended position. The control circuit is configured to determine whether the electronic lock is installed in the first handed configuration or the second handed configuration based on whether the at least one sensor detects the at least one orientation indicator. When the control circuit identifies the first handed configuration, the control circuit is configured to drive the motor in the forward mode to move the bolt towards the retracted position and to drive the motor in the reverse mode to move the bolt towards the extended position. When the control circuit identifies the second handed configuration, the control circuit is configured to drive the motor in the reverse mode to move the bolt towards the retracted position and to drive the motor in the forward mode to move the bolt towards the extended position.

In Example 2, the subject matter of Example 1 is further configured such that the at least one sensor is configured to wirelessly detect the at least one orientation indicator.

In Example 3, the subject matter of Example 2 is further configured such that the at least one sensor comprises a magnetic sensor and the at least one orientation indicator comprises a magnet fixedly mounted to the latch assembly, wherein the magnetic sensor is positioned with respect to the magnet to detect a threshold magnetic field of the magnet when the electronic lock is installed in the first handed configuration, but cannot detect the threshold magnetic field in the second handed configuration.

In Example 4, the subject matter of Example 2 is further configured such that the at least one sensor comprises an optical sensor and the at least one orientation indicator comprises a reflective surface fixedly mounted to the latch assembly, wherein the optical sensor is positioned with respect to the reflective surface to detect a threshold light level reflected from the reflective surface when the electronic lock is installed in the first handed configuration, but does not detect the threshold light level in the second handed configuration.

In Example 5, the subject matter of Example 2 is further configured such that the at least one sensor comprises a RF receiver and the at least one orientation indicator comprises a RF reflector fixedly mounted to the latch assembly, wherein the RF receiver is positioned with respect to the RF reflector to detect a threshold RF signal level reflected from the RF reflector when the electronic lock is installed in the first handed configuration, but does not detect the threshold RF signal level in the second handed configuration.

In Example 6, the subject matter of Example 1 is further configured such that the latch assembly includes a stationary sleeve into which the bolt is at least partially received and from which the bolt at least partially retracts, wherein the at least one orientation indicator is positioned on the stationary sleeve.

In Example 7, the subject matter of Example 1 is further configured such that the at least one orientation indicator comprises a first orientation indicator and a second orientation indicator, wherein the first orientation indicator and the second orientation indicator are offset from each other about the longitudinal axis of the latch assembly.

In Example 8, the subject matter of Example 7 is further configured such that the first orientation indicator and the second orientation indicator are substantially coaxial.

In Example 9, the subject matter of Example 7 is further configured such that the at least one sensor comprises a first sensor and a second sensor spaced apart from the first sensor.

In Example 10, the subject matter of Example 9 is further configured such that the first sensor is positioned with respect to the first orientation indicator to detect the first orientation indicator when the electronic lock is installed in the first handed configuration, but not the second orientation indicator.

In Example 11, the subject matter of Example 10 is further configured such that the second sensor is spaced apart from the first sensor to not detect the first orientation indicator when the electronic lock is installed in the first handed configuration.

In Example 12, the subject matter of Example 11 is further configured such that the second sensor is positioned with respect to the second orientation indicator to detect the second orientation indicator when the electronic lock is installed in the second handed configuration, but not the first orientation indicator.

In Example 13, the subject matter of Example 12 is further configured such that the first sensor is spaced apart from the second sensor to not detect the second orientation indicator when the electronic lock is installed in the second handed configuration.

In Example 14, the subject matter of Example 9 is further configured such that the first sensor and the second sensor are offset from the latch assembly on a same side of the latch assembly.

Example 15 is a method for detecting a handed configuration of a door. The method includes the step of providing an electronic lock including a latch assembly having a bolt movable between an extended position and a retracted position, a motor configured to drive the bolt between the extended position and the retracted position, a control circuit for controlling the motor to selectively move the bolt between the extended position and the retracted position, at least one sensor in electrical communication with the control circuit, and at least one orientation indicator. The at least one sensor detects the presence of the at least one orientation indicator. The control circuit identifies a handed configuration based on the detection by the at least one sensor. The control circuit drives the motor based on the identified handed configuration and this happens without moving the bolt between the extended position and the retracted position.

In Example 16, the subject matter of Example 15 is further configured such that the at least one orientation indicator comprises a first orientation indicator and a second orientation indicator positioned on opposing sides of a longitudinal axis of the latch assembly.

In Example 17, the subject matter of Example 16 is further configured such that the first orientation indicator and the second orientation indicator are coaxial about an axis traverse to the longitudinal axis of the latch assembly.

In Example 18, the subject matter of Example 17 is further configured such that the at least one sensor comprises a first sensor spaced apart from a second sensor, wherein the first sensor, but not the second sensor, is coaxial with the first orientation indicator when the electronic lock is installed in a left-handed configuration.

In Example 19, the subject matter of Example 18 is further configured such that the second sensor, but not the first sensor, is coaxial with the second orientation indicator when the electronic lock is installed in a right-handed configuration.

In Example 20, the subject matter of Example 15 is further configured such that the at least one sensor is configured to wirelessly detect the at least one orientation indicator.

What is claimed is:

1. An electronic lock comprising:

a latch assembly comprising:

a bolt selectively moveable between a retracted position and an extended position; and at least one orientation indicator associated with the latch assembly and having a fixed position thereon, wherein the bolt is moveable relative to the at least one orientation indicator;

a torque blade; and at least one drive assembly coupled to the latch assembly via the torque blade and configured to drive movement of the bolt between the retracted position and the extended position, the at least one drive assembly comprising:

a motor configured to drive in two opposing directions;

a control circuit configured to control operation of the motor; and at least one sensor coupled in communication with the control circuit and positioned with respect to the latch assembly, wherein based on a relative position between the at least one sensor and the at least one orientation indicator, the control circuit is configured to determine a handed configuration of the electronic lock such that one drive direction of the motor corresponds to moving the bolt towards the retracted position and the other drive direction of the motor corresponds to moving the bolt towards the extended position.

2. The electronic lock of claim 1, wherein the latch assembly further comprises a sleeve at least partially housing the bolt, the at least one orientation indicator coupled to the sleeve.

3. The electronic lock of claim 1, wherein the at least one orientation indicator includes a first orientation indicator associated with a first side of the latch assembly and a second orientation indicator associated with an opposite second side of the latch assembly.

4. The electronic lock of claim 1, wherein the bolt defines a longitudinal axis, the at least one orientation indicator aligned along an axis transverse to the longitudinal axis.

5. The electronic lock of claim 1, wherein the bolt defines a longitudinal axis, the at least one orientation indicator spaced apart from the torque blade along the longitudinal axis.

6. The electronic lock of claim 1, wherein the at least one drive assembly is an interior assembly configured for mounting on an interior surface of a door.

7. The electronic lock of claim 1, wherein the at least one sensor includes a first sensor and a second sensor, the first sensor and the second sensor spaced apart from one another and both facing towards the latch assembly.

8. The electronic lock of claim 1, wherein the bolt defines a longitudinal axis, the at least one sensor aligned along an axis transverse to the longitudinal axis.

9. The electronic lock of claim 1, wherein the at least one orientation indicator includes a magnet, a reflective surface, a protrusion, or a RF transmitter or reflector.

10. The electronic lock of claim 1, wherein the at least one sensor a magnetic sensor, an optical sensor, a mechanical switch, an ultrasonic proximity switch or sensor, or a RF receiver.

11. A method for determining a handed configuration of an electronic lock having a latch assembly and at least one drive assembly coupled together via a torque blade, wherein the latch assembly includes a bolt movable relative to at least one orientation indicator and the at least one drive assembly includes a motor, a control circuit, and at least one sensor, wherein the method comprises:

positioning the latch assembly relative to the at least one drive assembly;

detecting, by the control circuit, the relative position between the at least one sensor and the at least one orientation indicator; and identifying, by the control circuit, the handed configuration of the electronic lock, wherein the control circuit identifies the handed configuration without driving the motor to extend or retract the bolt, and wherein the handed configuration of the electronic lock sets a first drive direction of the motor as corresponding to moving the bolt towards an extended configuration and an opposite second drive direction of the motor as corresponding to moving the bolt towards a retracted configuration.

12. The method of claim 11, wherein the at least one orientation indicator includes a first orientation indicator and a second orientation indicator and the at least one sensor includes a first sensor and a second sensor, and wherein identifying the handed configuration of the electronic lock includes detecting, by the first sensor, the first orientation indicator to set a first handed configuration or detecting, by the second sensor, the second orientation indicator to set a second handed configuration.

13. The method of claim 12, wherein when the first sensor detects the first orientation indicator, the second sensor does not detect the second orientation indicator, and when the second sensor detects the second orientation indicator, the first sensor does not detect the first orientation indicator.

14. The method of claim 11, wherein the at least one sensor includes a first sensor and a second sensor, and wherein identifying the handed configuration of the electronic lock includes detecting, by the first sensor, the at least one orientation indicator to set a first handed configuration or detecting, by the second sensor, the at least one orientation indicator to set a second handed configuration.

15. The method of claim 14, wherein when the first sensor detects the at least one orientation indicator, the second sensor does not detect the at least one orientation indicator, and when the second sensor detects the at least one orientation indicator, the first sensor does not detect the at least one orientation indicator.

16. The method of claim 11, further comprising preconfiguring an initial handed configuration of the electronic lock.

17. The method of claim 16, wherein based on the detection of the relative position between the at least one sensor and the at least one orientation indicator, the initial handed configuration of the electronic lock is maintained.

18. The method of claim 16, wherein based on the detection of the relative position between the at least one sensor and the at least one orientation indicator, the initial handed configuration of the electronic lock is changed.

19. The method of claim 11, wherein the detection of the relative position between the at least one sensor and the at least one orientation indicator is performed magnetically, optically, mechanically, ultrasonically, or by an RF signal.

20. The method of claim 11, further comprising driving, by the control circuit, the motor based on the identified handed configuration.

* * * * *